United States Patent [19]

Okumura et al.

[11] 4,028,282

[45] June 7, 1977

[54] METHOD OF MANUFACTURING GRANULAR DETERGENTS

[75] Inventors: Osamu Okumura, Funabashi; Takenobu Sakatani, Chiba; Izumi Yamane, Yokohama; Toshinobu Kashiwada, Chiba, all of Japan

[73] Assignee: Lion Fat & Oil Co., Ltd., Tokyo, Japan

[22] Filed: May 5, 1976

[21] Appl. No.: 683,387

[30] Foreign Application Priority Data

May 14, 1975 Japan ..... 50-57094

[52] U.S. Cl. ..... 252/537; 252/536

[51] Int. Cl.[2] ..... C11D 1/14; C11D 3/10

[58] Field of Search ..... 252/536, 537

[56] References Cited

UNITED STATES PATENTS 3,816,352 6/1974 Loureiro et al. ..... 252/536 X 3,892,680 7/1975 Benjamin et al. ..... 252/536 X 3,950,276 4/1976 Grand ..... 252/536

*Primary Examiner*—Harris A. Pitlick

*Attorney, Agent, or Firm*—Woodhams, Blanchard and Flynn

[57] ABSTRACT

The present invention relates to a method of manufacturing granular detergents having good biodegradability, mildness to the skin, an appropriate breaking strength of the granules, a desired bulk density and a satisfactory free-flowability, by heating a detergent slurry and atomizing it in an ambient or cold atmosphere, wherein the detergent slurry employed is a mixture consisting of 10 to 30 wt.% of olefin sulfonate having 10 to 22 carbon atoms, 60 to 90 wt.% of sodium carbonate, sodium silicate and water and 0 to 30 wt.% of other well-known additives, and the ratio of said sodium carbonate, sodium silicate and water is in a specific range.

3 Claims, 2 Drawing Figures

MIXING RATIO OF SODIUM CARBONATE–SODIUM SILICATE–WATER (THREE COMPONENTS SYSTEM)

POINT(X,Y,Z,) A (58.5, 2.5, 39)
B (86.5, 2.5, 11)
C (23, 66, 11)
D (41, 20, 39)

NOTE; THE UNIT SIGNIFIES PARTS BY WEIGHT.

MIXING RATIO OF SODIUM CARBONATE–SODIUM SILICATE–WATER (THREE COMPONENTS SYSTEM)

POINT(X,Y,Z,) A (58.5, 2.5, 39)
B (86.5, 2.5, 11)
C ( 23, 66, 11)
D (41, 20, 39)

NOTE; THE UNIT SIGNIFIES PARTS BY WEIGHT.

MIXING RATIO OF SODIUM CARBONATE–SODIUM SILICATE–WATER (THREE COMPONENTS SYSTEM)

NOTE; THE UNIT SIGNIFIES PARTS BY WEIGHT.

METHOD OF MANUFACTURING GRANULAR DETERGENTS

BACKGROUND OF THE INVENTION a. Field of the Invention

The present invention relates to a method of manufacturing granular detergents which comprise an olefin sulfonate, said detergents being superior in biodegradability and mildness to the skin and having an appropriate breaking strength of the granules a desired bulk density and a satisfactory free-flowability.

b. Description of the Prior Art

Powdery soap manufactured by atomizing a melted soap in a cold atmosphere has been used for washing cloths, but its use has gradually diminished with the appearance of granulated synthetic detergents. Nowadays, almost all the granular detergents are manufactured by the method comprising atomizing and drying a detergent slurry into a hot blast. This method is admittedly satisfactory in the case of a detergent slurry containing alkylbenzene sulfonate and relatively much sodium tripolyphosphate, but it is unsuitable now that the use of sodium tripolyphosphate has been restricted and an olefin sulfonate having the same excellent detergency as alkylbenzene sulfonate and being superior in biodegradability as well as mildness to the skin is to be employed as the main ingredient of the detergent. Compared with the conventional alkylbenzene sulfonate-tripolyphosphate type detergent slurry, a detergent slurry comprising an olefin sulfonate is inferior in the physical properties of the slurry such as viscosity, spinnability, fluidity and so forth. Further, the bulk density and free-flowability as well as the breaking strength of the granules made of this detergent slurry is very insufficient. Therefore, a granular detergent manufactured by this method is light so that it is apt to pulverize and coagulate.

Moreover, on account of the intrinsic properties of olefin sulfonate per se, this method is defective because it is difficult to produce a granular detergent having good controlled suds in washing, and such properties cannot be improved even when sodium tripolyphosphate is employed in great quantities and the amount of the olefin sulfonate is reduced.

Besides, as a common defect of spray drying methods, waste of a lot of heat energy can be cited.

Meanwhile, there has been disclosed in Japanese Patent Publication No. 3125/1964 a method of manufacturing granular detergents by the spray cooling process similar to the method of manufacturing powdery soap. However, this method has scarcely been put to practical use industrially because it is not always capable of producing a satisfactory granular detergent in respect of the breaking strength of the granules, free-flowability, storage stability, rate of dissolving, etc. in the case of a detergent slurry comprising an olefin sulfonate.

SUMMARY OF THE INVENTION

A principal object of the present invention is to avoid the foregoing defects of the prior art and to provide a method of manufacturing granular detergents which renders it possible to put to practical use the art of subjecting a detergent slurry comprising an olefin sulfonate to spray cooling and economize energy by strictly specifying the amount of the respective components of the detergent slurry to be employed.

Another object of the present invention is to provide a method of manufacturing granular detergents which are satisfactory with respect to such properties as bulk density, breaking strength of the granules, free-flowability, storage stability, rate of dissolving, etc.

A further object of the present invention is to provide a method of manufacturing granular detergents having the same excellent detergency as alkylbenzene sulfonates and which are superior in biodegradability as well as mildness to the skin.

A still further object of the present invention is to provide a method of manufacturing granular detergents which can provide controlled suds during washing.

In other words, the method of manufacturing granular detergents according to the present invention comprises subjecting a detergent slurry to heating and then atomizing it in an ambient or cold atmosphere, wherein the detergent slurry employed is a mixture consisting of 10 to 30 wt. % of olefin sulfonate having 10 to 22 carbon atoms, 60 to 90 wt. % of sodium carbonate, sodium silicate and water and 0 to 30 wt. % of other well-known detergent additives, and the ratio of said sodium carbonate, sodium silicate and water lies within the closed polygon defined by points A, B, C, and D in FIG. 1 of the appended drawings.

The present inventors have found that the aforesaid objects cannot be attained in an olefin sulfonate-sodium carbonate-water system, but the addition of a specific amount of sodium silicate to this system causes a synergistic effect whereby these objects can be attained.

The appropriate temperature for heating the detergent slurry in the method of the present invention is in the range of from 70° to 180° C, preferably from 95° to 160° C, from the view point of the change of phase, the viscosity and the fluidity of slurry as well as the storage stability of the resulting granular detergent, and the thus heated detergent slurry is atomized in an ambient or cold atmosphere thereby to effect granulation. The appropriate spray nozzle for the purpose of atomization in the present invention is a two-fluid type spray nozzle capable of spraying said slurry together with hot steam or hot air; yet it is possible to apply a one-fluid type spray nozzle thereby to atomize said slurry with the aid of a high pressure pump.

To cite olefin sulfonates applicable to the present invention, there are alkali metal or alkaline earth metal olefin sulfonates obtained by subjecting an $\alpha$-olefin, an inner olefin or a vinylidene-type olefin having 10 to 22 carbon atoms, inclusive of a mixture of these olefins, prepared by wax cracking, ethylene polymerization with Ziegler catalyst or another method, to sulfonation by the use of a conventional continuous thin film type sulfonator, followed by neutralization with a hydroxide of an alkali metal or an alkaline earth metal and hydrolysis in succession.

As to the sodium carbonate for use in the present invention, either an anhydride or a hydrate of sodium carbonate will do, and any commercial sodium carbonate is applicable. As to the sodium silicate for use in the present invention, ones as having a molar ratio of $SiO_2$ to $Na_2O$ in the range of from 2.0 to 3.0 are applicable.

The detergent slurry for use in the present invention must contain 10 to 30 wt.% of olefin sulfonate from the view point of detergency. The amount of sodium carbonate, sodium silicate and water must be in the range of from 60 to 90 wt.% and the ratio of these three components must lie within the area bounded by points A, B, C and D in FIG. 1. The line drawn between B and C signifies that the amount of water must be more than 11 percent by weight, based on the combined weights of the three components; when the amount of water is less than this, the viscosity of the slurry increases sharply and the fluidity of same becomes very poor, whereby it becomes difficult to maintain the slurry phase, resulting in a failure to achieve a uniformly mixed state of the slurry. The line drawn between A and B signifies the lower limit of the amount of sodium silicate to be employed, the line drawn between A and D signifies the upper limit of the amount of water to be employed, and the line drawn between D and C signifies the amount which depends on the balance of efficiency of the three components. In the case where the mixing ratio of the three components is outside the area bounded by lines connecting points B, A, D and C, the breaking strength of the granules of the resulting granular detergent becomes poor, and the free-flowability and the storage stability of the granular detergent, instead of being improved, become very inferior. Further, the amount of water to be contained in the detergent slurry should be more than 8 wt.%, preferably more than 10 wt.%. In this connection, the sodium silicate used in the present invention is, as described in the foregoing, a sodium silicate having the aforementioned molar ratio of $SiO_2$ to $Na_2O$, and the reason why a sodium silicate of this type is effective in producing a granular detergent of superior quality when employed at a specific mixing ratio in the olefin sulfonate-sodium carbonate-sodium silicate system despite the generally accepted idea that it has no water of crystallization is considered attributable to a peculiar chemical action of sodium silicate.

As said other well-known detergent additives useful in the present invention, there are anionic, nonionic and amphoteric surface active agents, inorganic or organic builders, anti-redeposition agent, foam stabilizer, foam booster, anticaking agent, optical brightener, perfume, etc., and compounds capable of forming water-containing crystals are also included therein. These compounds can be contained in the detergent slurry for use in the present invention to the extent of 0 to 30 wt.%. To cite applicable compounds, there are such surface active agents as alkylbenzene sulfonates in which the alkyl has 11 to 14 carbon atoms, alkyl sulfonates having 8 to 18 carbon atoms, salts of α-sulfofatty acid esters having 8 to 22 carbon atoms, polyoxyethylene ethers of alcohols having 8 to 18 carbon atoms, alkylphenol polyoxyethylene ethers in which the alkyl has 7 to 14 carbon atoms, polyoxyalkylene glycols, long-chain-alkyl quaternary ammonium betaines, long-chain-alkyl quaternary ammonium sulfobetaines, etc., such inorganic salts as sodium sesquicarbonate, potassium carbonate, sodium metasilicate, sodium orthosilicate, sodium sulfate, magnesium sulfate, ammonium sulfate, calcium sulfate, sodium sulfite, sodium thiosulfate, sodium tetraborate (borax), sodium tripolyphosphate, sodium pyrophosphate, potassium pyrophosphate, sodium phosphate, disodium hydrogen phosphate, calcium chloride, sodium percarbonate, sodium perborate, sodium persulfate, sodium perpyrophosphate, etc., and such organic salts as sodium acetate, sodium citrate, sodium tartrate, potassium tartrate, potassium tartrate, sodium succinate, potassium succinate, sodium oxalate, potassium oxalate, sodium malonate, potassium malonate, p-hydroxybenzoic acid or sodium salt thereof, calcium stearate, etc.

Hereunder will be given examples embodying the present invention.

DESCRIPTION OF THE PREFERRED EMBODIMENTS

EXAMPLE 1

A slurry of α-olefin sulfonate (AOS) having 15 to 18 carbon atoms was put in a blending tank and heated up to a temperature of 60° C. Next, after adding thereto a certain amount of sodium carbonate and sodium silicate (molar ratio of $SiO_2$ to $Na_2O$: 2.2) and thoroughly stirring for 10 minutes at a specific temperature, the resulting detergent slurry was granulated by atomizing at room-temperature through a two-fluid type spray nozzle (employing hot air).

When the bulk density (BD), the breaking strength of the granules (ΔBD) and the free-flowability of the thus prepared granular detergent were measured, the results were as shown in the following Table-1.

The method of measuring the breaking strength of the granules (ΔBD) was as follows. That is, by feeding the product granular detergent to an air-lift (air speed: 10 m/sec), the bulk density thereof was measured both at the inlet and outlet of said air-lift, and the breaking strength of the granules was represented by the difference of two values of bulk density (i.e., ΔBD) thus obtained.

Measuring of free-flowability

Granular detergents prepared by the foregoing method were packed in cartons. After opening the tops of said cartons, the cartons were inclined and were flowed downwardly through the outlet by gravity with slight shocks as needed to effect flow. The condition of flow of the detergent was observed.

| Evaluation of the flowing condition | |
|---|---|
| score | condition |
| 5 | Flow continuously |
| 4 | Flow well, but stop twice or three times |
| 3 | Flow intermittently |
| 2 | Did not flow down, but after one shock full detergent flow down by gravity |
| 1 | Did not flow down, but after two or three shocks full detergent flow down by gravity |
| 0 | Did not flow down after five shocks |

The storage stability of the granular detergent was evaluated by applying the same method as described above after storing it for 24 hours at a temperature of 35° C upon packing in the same way as in the case of the free-flowability.

In the evaluation of the physical property of the slurry, the mark ○ signifies 'satisfactory', Δ signifies 'fairly satisfactory', and X signifies 'unsatisfactory'.

Table-1

| No. | Position in FIG. 2 | Temperature of slurry (° C) | Composition of detergent (%) | | | | Properties of granule | | | | Physical property of slurry |
|---|---|---|---|---|---|---|---|---|---|---|---|
| | | | AOS | $Na_2CO_3$ | sodium silicate | water | BD (g/ml) | ΔBD | free-flowability | storage stability | |
| 1 | a | | 20 | 47 | 2 | 31 | 0.56 | 0.04 | 4 | 4 | ○ |

Table-1-continued

| No. | Position in FIG. 2 | Temperature of slurry (° C) | Composition of detergent (%) AOS | $Na_2CO_3$ | sodium silicate | water | Properties of granule BD (g/ml) | ΔBD | free-flow-ability | storage stability | Physical property of slurry |
|---|---|---|---|---|---|---|---|---|---|---|---|
| 2 | b | | " | 58 | 2 | 20 | 0.54 | 0.02 | 4 | 4 | ○ |
| 3 | c | | " | 69 | 2 | 9 | 0.55 | 0.01 | 4 | 4 | Δ |
| 4 | d | | " | 35 | 36 | 9 | 0.56 | 0.01 | 4 | 4 | Δ |
| 5 | e | 90 | " | 19 | 52 | 9 | 0.55 | 0.02 | 4 | 4 | Δ |
| 6 | f | | " | 26 | 34 | 20 | 0.58 | 0.02 | 4 | 4 | ○ |
| 7 | g | | " | 33 | 16 | 31 | 0.61 | 0.03 | 4 | 4 | ○ |
| 8 | h | | " | 41 | 8 | 31 | 0.56 | 0.03 | 4 | 4 | ○ |
| 9 | i | | " | 44 | 16 | 20 | 0.57 | 0.02 | 5 | 5 | ○ |
| 10 | a | | 20 | 47 | 2 | 31 | 0.53 | 0.03 | 4 | 4 | ○ |
| 11 | b | | " | 58 | 2 | 20 | 0.52 | 0.02 | 5 | 4 | ○ |
| 12 | c | | " | 69 | 2 | 9 | 0.53 | 0.01 | 5 | 4 | Δ |
| 13 | d | | " | 35 | 36 | 9 | 0.51 | 0.01 | 5 | 4 | Δ |
| 14 | e | 120 | " | 19 | 52 | 9 | 0.53 | 0.02 | 5 | 4 | Δ |
| 15 | f | | " | 26 | 34 | 20 | 0.52 | 0.02 | 5 | 4 | ○ |
| 16 | g | | " | 33 | 16 | 31 | 0.51 | 0.03 | 4 | 4 | ○ |
| 17 | h | | " | 41 | 8 | 31 | 0.52 | 0.03 | 4 | 4 | ○ |
| 18 | i | | " | 44 | 16 | 20 | 0.53 | 0.01 | 5 | 5 | ○ |
| Comparative Example | | | | | | | | | | | |
| 1 | a' | | 20 | 49 | 0 | 31 | 0.52 | 0.07 | 1 | 1 | ○ |
| 2 | b' | | " | 60 | 0 | 20 | 0.53 | 0.06 | 1 | 1 | ○ |
| 3 | c' | | " | 71 | 0 | 9 | 0.50 | 0.06 | 3 | 2 | X |
| 4 | d' | 120 | " | 37 | 36 | 7 | 0.51 | 0.04 | 3 | 2 | X |
| 5 | e' | | " | 17 | 54 | 9 | 0.51 | 0.05 | 3 | 2 | X |
| 6 | f' | | " | 24 | 36 | 20 | 0.52 | 0.05 | 1 | 1 | ○ |
| 7 | g' | | " | 31 | 18 | 31 | 0.52 | 0.06 | 1 | 1 | ○ |
| 8 | h' | | " | 37 | 10 | 33 | 0.51 | 0.08 | 1 | 1 | ○ |

From Table-1, a synergistic effect on the breaking strength of the granules (ΔBD), free-flowability, storage stability and the property of slurry can be displayed only when the $Na_2CO_3$-sodium silicate-water system is of a specific ratio.

EXAMPLE 2

By employing a vinylidene olefin sulfonate (VOS) as a surface active agent in stead of the AOS employed in Example 1 and applying the same procedure as described in Example 1, granulation of detergent slurry was performed. When the properties of granules and the physical property of the slurry were examined, the results were as shown in the following Table-2.

Table 2

| No. | Position in Fig. 2 | Temperature of slurry (° C) | Composition of detergent (%) VOS | $Na_2CO_3$ | sodium silicate | water | Properties of granule BD (g/ml) | ΔBD | free-flow-ability | storage stability | Physical property of slurry |
|---|---|---|---|---|---|---|---|---|---|---|---|
| 1 | a | | 20 | 47 | 2 | 31 | 0.55 | 0.03 | 4 | 4 | ○ |
| 2 | b | | " | 58 | 2 | 20 | 0.57 | 0.02 | 4 | 4 | ○ |
| 3 | c | | " | 69 | 2 | 9 | 0.56 | 0.02 | 4 | 4 | Δ |
| 4 | d | | " | 35 | 36 | 9 | 0.54 | 0.01 | 4 | 4 | Δ |
| 5 | e | 90 | " | 19 | 52 | 9 | 0.55 | 0.01 | 4 | 4 | Δ |
| 6 | f | | " | 26 | 34 | 20 | 0.56 | 0.02 | 4 | 4 | ○ |
| 7 | g | | " | 33 | 16 | 31 | 0.57 | 0.02 | 4 | 4 | ○ |
| 8 | h | | " | 41 | 8 | 31 | 0.57 | 0.02 | 4 | 4 | ○ |
| 9 | i | | " | 44 | 16 | 20 | 0.56 | 0.02 | 5 | 5 | ○ |
| 10 | a | | 20 | 47 | 2 | 31 | 0.51 | 0.02 | 4 | 4 | ○ |
| 11 | b | | " | 58 | 2 | 20 | 0.53 | 0.02 | 4 | 4 | ○ |
| 12 | c | | " | 69 | 2 | 9 | 0.52 | 0.01 | 5 | 5 | Δ |
| 13 | d | | " | 35 | 35 | 9 | 0.52 | 0.01 | 5 | 5 | Δ |
| 14 | e | 120 | " | 19 | 52 | 9 | 0.51 | 0.01 | 5 | 4 | Δ |
| 15 | f | | " | 26 | 34 | 20 | 0.53 | 0.02 | 5 | 4 | ○ |
| 16 | g | | " | 33 | 16 | 31 | 0.52 | 0.03 | 4 | 4 | ○ |
| 17 | h | | " | 41 | 8 | 31 | 0.50 | 0.03 | 4 | 4 | ○ |
| 18 | i | | " | 44 | 16 | 20 | 0.51 | 0.01 | 5 | 5 | ○ |
| Comparative Example | | | | | | | | | | | |
| 9 | a' | | 20 | 49 | 0 | 31 | 0.53 | 0.06 | 1 | 1 | ○ |
| 10 | b' | | " | 60 | 0 | 20 | 0.52 | 0.08 | 1 | 1 | ○ |
| 11 | c' | | " | 71 | 0 | 9 | 0.52 | 0.06 | 3 | 2 | X |
| 12 | d' | 120 | " | 37 | 36 | 7 | 0.51 | 0.07 | 3 | 2 | X |
| 13 | e' | | " | 17 | 54 | 9 | 0.53 | 0.07 | 3 | 2 | X |
| 14 | f' | | " | 24 | 36 | 20 | 0.52 | 0.06 | 1 | 1 | ○ |
| 15 | g' | | " | 31 | 18 | 31 | 0.51 | 0.07 | 1 | 1 | ○ |
| 16 | h' | | " | 37 | 10 | 33 | 0.52 | 0.08 | 1 | 1 | ○ |

From Table-2, in the case where a vinylidene sulfonate was employed, the results were as satisfactory as in Example 1.

EXAMPLE 3

By applying the same composition as that of Nos. 1, 3, 5, 7 and 9 in Example 1 and the same procedure as described in Example 1 except the temperature of slurry, granulation was performed. When the properties of the granules and the physical property of the slurry were examined, the results were as shown in the following Table-3.

Table 3

| | | Position in Fig. 2 | Temperature of slurry (° C) | Properties of granule | | | | Physical property of slurry |
|---|---|---|---|---|---|---|---|---|
| | | | | BD (g/ml) | ΔBD | free-flowability | storage stability | |
| No. 1 | of Example 1 | a | | 0.57 | 0.07 | 1 | 1 | Δ |
| No. 3 | " | c | | 0.56 | 0.08 | 2 | 1 | X |
| No. 5 | " | e | 60 | 0.55 | 0.07 | 2 | 1 | X |
| No. 7 | " | g | | 0.57 | 0.09 | 1 | 1 | Δ |
| No. 9 | " | i | | 0.57 | 0.08 | 1 | 1 | X |
| No. 1 | of Example 1 | a | | 0.55 | 0.03 | 4 | 4 | ○ |
| No. 3 | " | c | | 0.54 | 0.02 | 4 | 4 | Δ |
| No. 5 | " | e | 70 | 0.55 | 0.03 | 4 | 4 | Δ |
| No. 7 | " | g | | 0.55 | 0.03 | 4 | 4 | ○ |
| No. 9 | " | i | | 0.56 | 0.02 | 5 | 5 | Δ |
| No. 1 | of Example 1 | a | | 0.53 | 0.03 | 4 | 4 | ○ |
| No. 3 | " | c | | 0.53 | 0.01 | 5 | 4 | Δ |
| No. 5 | " | e | 120 | 0.53 | 0.02 | 5 | 4 | Δ |
| No. 7 | " | g | | 0.51 | 0.03 | 4 | 4 | ○ |
| No. 9 | " | i | | 0.53 | 0.01 | 5 | 5 | ○ |
| No. 1 | of Example 1 | a | | 0.50 | 0.03 | 4 | 4 | ○ |
| No. 3 | " | c | | 0.51 | 0.01 | 4 | 4 | ○ |
| No. 5 | " | e | 180 | 0.52 | 0.03 | 4 | 4 | ○ |
| No. 7 | " | g | | 0.50 | 0.04 | 4 | 4 | ○ |
| No. 9 | " | i | | 0.51 | 0.02 | 5 | 5 | ○ |
| No. 1 | of Example 1 | a | | 0.51 | 0.06 | 2 | 1 | ○ |
| No. 3 | " | c | | 0.50 | 0.08 | 2 | 2 | ○ |
| No. 5 | " | e | 200 | 0.51 | 0.07 | 2 | 1 | ○ |
| No. 7 | " | g | | 0.50 | 0.07 | 2 | 1 | ○ |
| No. 9 | " | i | | 0.52 | 0.08 | 3 | 3 | ○ |

From Table-3, the appropriate temperature of the slurry is in the range of from 70° to 180° C.

EXAMPLE 4

When the same test as described in Example 1 was employed, using an olefin sulfonate prepared by sulfonating an olefin composed of 65% of α-olefin, 23% of vinylidene olefin and 12% of inner olefin, followed by neutralization with caustic soda and hydrolysis successively, a satisfactory synergistic effect was realized only in the case wherein the olefin sulfonate-sodium carbonate-sodium silicate-water system (or four-component system) was of a specific ratio. This conclusion was quite the same as in Example 1.

EXAMPLES 5 through 13

Various granular detergents having the composition shown in the following Table-4 respectively were tested in the same way as described in Example 1 except that the temperature of slurry was fixed at 120° C. The results were as shown in the following Table-4.

Table 4

| Example | Composition of detergent (%) | | | | | | Properties of granule | | | | Physical property of slurry |
|---|---|---|---|---|---|---|---|---|---|---|---|
| | AOS | other active agents | $Na_2CO_3$ | sodium silicate | other additives | water | BD (g/ml) | ΔBD | free-flowability | storage stability | |
| | | | | | | 17 | | | | | |
| Example 5 | 15 | 5 [1] | 53 | 10 | 0 | 17 | 0.52 | 0.01 | 5 | 5 | ○ |
| Example 6 | 15 | 5 [2] | 53 | 10 | 0 | 17 | 0.51 | 0.01 | 5 | 5 | ○ |
| Example 7 | 15 | 5 [3] | 53 | 10 | 0 | 17 | 0.50 | 0.01 | 5 | 5 | ○ |
| Example 8 | 20 | 0 | 45 | 10 | 8 [4] | 17 | 0.52 | 0.01 | 5 | 5 | ○ |
| Example 9 | 20 | 0 | 45 | 10 | 8 [5] | 17 | 0.50 | 0.01 | 5 | 5 | ○ |
| Example 10 | 20 | 0 | 45 | 10 | 8 [6] | 17 | 0.51 | 0.01 | 5 | 5 | ○ |
| Example 11 | 15 | 5 [2] | 45 | 10 | 8 [4] | 17 | 0.52 | 0.01 | 5 | 5 | ○ |
| Example 12 | 15 | 5 [2] | 45 | 10 | 8 [6] | 17 | 0.53 | 0.01 | 5 | 5 | ○ |
| Example 13 | 15 | 5 [3] | 45 | 10 | 8 [6] | 17 | 0.52 | 0.01 | 5 | 5 | ○ |

(Remarks)
[1] Straight-chain alkylbenzene sulfonate having 11 to 14 carbon atoms
[2] Sulfate of aliphatic alcohol having 12 to 15 carbon atoms
[3] Ethylene oxide condensate ($\bar{p}$=14) of aliphatic alcohol having 12 to 15 carbon atoms
[4] Sodium sulfate
[5] Sodium tripolyphosphate
[6] Sodium citrate From Table-4, the addition of other active ingredients and/or other additives to a blend of α-olefin sulfonate, sodium carbonate, sodium silicate and water composed at a specific ratio has no influence upon the characteristics of the granules of the resulting granular detergent.

EXAMPLE 14

The detergency, controlled sudsing and rate of dissolving of the granular detergent prepared in Example 1-No. 18 were compared with the counterparts of comparative examples having the compositions shown in the following, respectively.

| | Comparative Example 17 | Comparative Example 18 |
|---|---|---|
| $C_{15}$ – $C_{18}$ olefin sulfonate | 17 wt.% | 23 wt.% |
| sodium tripolyphosphate | 20 | 0 |
| sodium carbonate | 4 | 5 |
| sodium silicate (wherein the ratio of $SiO_2$ to $Na_2O$=2.2) | 10 | 14 |
| soap | 1 | 1 |
| carboxymethyl cellulose | 1 | 1 |
| sodium sulfate | 39 | 48 |
| water | 8 | 8 |

The test methods were as follows. Evaluation of the detergency for soil comprising artificial sebum:

The following organic soil components were mixed together by heating at a temperature in the range of from 60° to 80° C. Then, the resulting mixture was cooled to room temperature, followed by adding clay on inorganic soil component and carbon black thereto and admixing thoroughly.

| | |
|---|---|
| organic soil | myristic acid<br>oleic acid<br>tristearin<br>triolefin<br>cholesterol<br>cholesterol stearate<br>paraffin wax<br>squalene |
| inorganic soil | clay: prepared by drying 'Shimosueyoshi loam' at 800° C for 3 hours and thereafter crushing and passing through a 325-mesh sieve. |
| organic/ inorganic/ carbon black | 49.75/49.75/0.5 |

The resulting artificial soil was uniformly coated on a piece of refined cloth and further rubbed over 50 times with a clean sponge, so as to prepare test pieces of which the surface has 42±2% of reflectance measured by Elrepho Reflectometer (Carl Zeiss Co.)

Washing condition
sample: 5cm x 5cm, 10 pieces
Terg-O-tometer: 120 r.p.m.
washing bath: 900 ml, 25° C, 3° dH
concentration: 0.133%
time: 10 min
bath ratio: 30
rinsing: 3 min.

The detergency was calculated by applying the following equation upon measuring the reflectance of the soiled cloths before and after the washing:

$$\text{detergency}(\%) = \frac{Rw - Rs}{Ro - Rs} \times 100$$

wherein:

Ro represents the reflectance (%) of clean cloth;

Rs represents the reflectance (%) of soiled cloth before washing;

Rw represents the reflectance of soiled cloth after washing.

Method of testing the controlled sudsing:

Detergent was diluted with water thereby to make the concentration of detergent 0.133%. 50 ml and 25 ml of the thus diluted detergent solution were diluted into 1 *l* of solution respectively. Each of the thus diluted solutions was respectively put into a cylinder with an inside diameter of 10 cm and left standing for 1 minute. Then, air was flowed into the cylinder from the bottom thereof for 1 minute at a flux of 40 *l*/mm and immediately thereafter the foam height was measured.

Rate of dissolving:

The rate of dissolving herein represents the time required for dissolving 1.33 g of detergent after putting in 1 *l* of water during stirring at a constant speed.

Table 5

| | Detergency (%) | foam height (mm) 0.133/20 (%) | foam height (mm) 0.133/40 (%) | rate of dissolving (sec) at 10° C | rate of dissolving (sec) at 25° C | rate of dissolving (sec) at 40° C |
|---|---|---|---|---|---|---|
| No. 18 of Example 1 | 89 | 70 | 40 | 100 | 30 | 25 |
| Comparative Example 17 | 90 | 140 | 110 | 240 | 180 | 160 |
| Comparative Example 18 | 88 | 190 | 140 | 230 | 175 | 150 |

Figure 1:
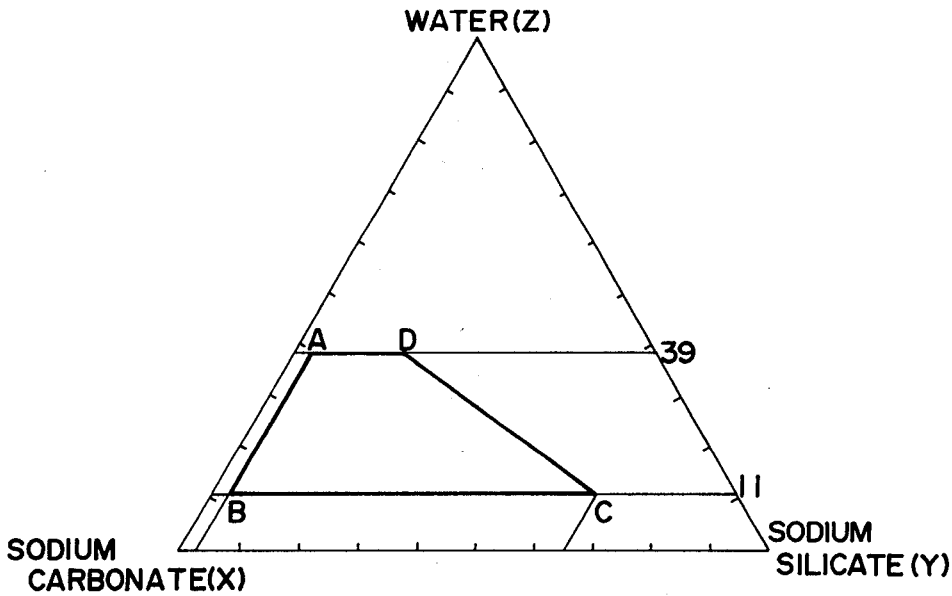
FIG. 1 is a graph illustrating the ratio of sodium carbonate, sodium silicate and water for use in the method of the present invention.
Figure 2:
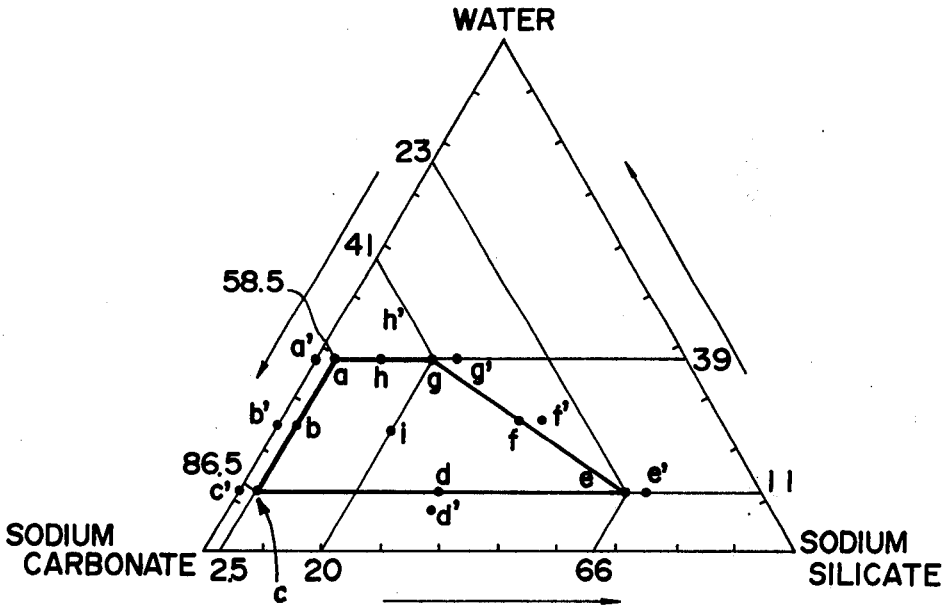
FIG. 2 is a graph illustrating the ratio of sodium carbonate, sodium silicate and water applied in the foregoing examples embodying the present invention as contrasted with the ratio of sodium carbonate, sodium silicate and water applied to comparative examples.

What is claimed is:

1. A method of manufacturing a granular detergent which comprises the steps of:

heating to a temperature of from 70° to 180° C a detergent slurry consisting essentially of a. from 10 to 30 weight percent of olefin sulfonate having from 10 to 22 carbon atoms b. from 60 to 90 weight percent of a mixture of sodium carbonate, sodium silicate and water, wherein the proportions of the ingredients of said mixture are on or within the closed polygon defined by points A, B, C and D in FIG. 1 of the attached drawings and wherein the molar ratio of $SiO_2$ to $Na_2O$ in said sodium silicate is in the range of from 2/1 to 3/1, and c. from zero to 30 weight percent of other detergent additives, and then atomizing said slurry and cooling it in an atmosphere having a temperature of room temperature or lower to transform same to granules.

2. A method according to claim 1, wherein said detergent slurry is heated to a temperature in the range of from 95° to 160° C.

3. A method according to claim 1, wherein said additive is at least one member selected from the group consisting of alkylbenzene sulfonates in which the alkyl has 11 to 14 carbon atoms, alkyl sulfates, having 8 to 18 carbon atoms, salts of α-sulfofatty acid esters having 8 to 22 carbon atoms, polyoxyethylene ethers of alcohols having 8 to 18 carbon atoms, alkylphenol polyoxyethylene ethers in which the alkyl has 7 to 14 carbon atoms, polyoxyalkylene glycols, long-chain-alkyl quaternary ammonium betaines, long-chain-alkyl quaternary ammonium sulfobetaines, sodium sesquicarbonate, potassium carbonate, sodium metasilicate, sodium orthosilicate, sodium sulfate, magnesium sulfate, ammonium sulfate, calcium sulfate, sodium sodium thiosulfate, sodium tetraborate, sodium tripolyphosphate, sodium pyrophosphate, potassium pyrophosphate, sodium phosphate, disodium hydrogen phosphate, calcium chloride, sodium percarbonate, sodium perborate, sodium persulfate, sodium perpyrophosphate, sodium acetate, sodium citrate, sodium tartrate, potassium tartrate, sodium succinate, potassium succinate, sodium oxalate, potassium oxalate, sodium malonate, potassium malonate, p-hydroxybenzoic acid or sodium salt thereof, and calcium stearate.

* * * * *

UNITED STATES PATENT AND TRADEMARK OFFICE

CERTIFICATE OF CORRECTION

PATENT NO. : 4 028 282

DATED : June 7, 1977

INVENTOR(S) : Osamu Okumura, Takenobu Sakatani, Izumi Yamane and Toshinobu Kashiwada It is certified that error appears in the above-identified patent and that said Letters Patent are hereby corrected as shown below:

Column 10, line 48; change "sulfates, having" to

---sulfates having---.

Column 10, line 58; change "sodium sodium" to

---sodium sulfite, sodium---.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*